US009888324B2

(12) United States Patent
Hu et al.

(10) Patent No.: US 9,888,324 B2
(45) Date of Patent: Feb. 6, 2018

(54) CAPACITIVE MICRO-ELECTRO-MECHANICAL SYSTEM MICROPHONE AND METHOD FOR MANUFACTURING THE SAME

(71) Applicant: MEMSensing Microsystems (Suzhou, China) Co., Ltd., Suzhou (CN)

(72) Inventors: Wei Hu, Suzhou (CN); Gang Li, Suzhou (CN)

(73) Assignee: Memsensing Microsystems (Suzhou, China) Co., Ltd., Suzhou, Jiangsu (CN)

( * ) Notice: Subject to any disclaimer, the term of this patent is extended or adjusted under 35 U.S.C. 154(b) by 0 days.

(21) Appl. No.: 14/811,589

(22) Filed: Jul. 28, 2015

(65) Prior Publication Data

US 2016/0088402 A1 Mar. 24, 2016

(30) Foreign Application Priority Data

Aug. 11, 2014 (CN) ..... 2014 1 0391494

(51) Int. Cl.
*H04R 19/00* (2006.01)
*H04R 19/04* (2006.01)
*H04R 7/20* (2006.01)

(52) U.S. Cl.
CPC ..... *H04R 19/005* (2013.01); *H04R 7/20* (2013.01); *H04R 19/04* (2013.01)

(58) Field of Classification Search
CPC ..... H04R 19/005; H04R 19/04; H04R 7/20; B81B 3/0072
See application file for complete search history.

(56) References Cited

U.S. PATENT DOCUMENTS 8,748,999 B2 * 6/2014 Chou ..... G01P 15/125 257/254
8,787,601 B2 * 7/2014 Suzuki ..... B81B 3/0072 367/163
9,380,393 B2 * 6/2016 Uchida ..... H04R 7/06
2003/0133588 A1 * 7/2003 Pedersen ..... B81B 3/0072 381/423

(Continued)

FOREIGN PATENT DOCUMENTS

CN 101123827 * 9/2011

*Primary Examiner* — Fan Tsang
*Assistant Examiner* — Angelica M McKinney
(74) *Attorney, Agent, or Firm* — Ladas & Parry, LLP

(57) ABSTRACT

The invention relates to a capacitive MEMS microphone and a method for manufacturing the same. The microphone includes: a substrate; a first dielectric supporting layer on the substrate; a movable sensitive layer formed on the first dielectric supporting layer and having a movable diaphragm extending within the air; a backplate disposed over the movable sensitive layer and spaced from the movable diaphragm; a chamber recessed from and extending through the substrate and the first dielectric supporting layer; and an impact resisting device connecting to the movable diaphragm. The impact resisting device is exposed downwardly and disposed above the chamber. The movable sensitive layer has a number of anchors formed around the movable diaphragm, a number of flexible beams each of which is employed to connect one of the anchors to the movable diaphragm, and a bonding portion connecting to the anchor.

15 Claims, 8 Drawing Sheets

(56) References Cited

U.S. PATENT DOCUMENTS

2012/0213400 A1* 8/2012 Kasai ..... H04R 19/04
381/369
2015/0001651 A1* 1/2015 Faralli ..... B81B 3/0021
257/417

* cited by examiner

CAPACITIVE MICRO-ELECTRO-MECHANICAL SYSTEM MICROPHONE AND METHOD FOR MANUFACTURING THE SAME

CROSS-REFERENCE TO RELATED APPLICATION(S)

This application claims the priority to Chinese Patent Application No. 201410391494.0, filed on Aug. 11, 2014 in the Chinese Intellectual Property Office, the disclosure of which is incorporated in its entirety herein by reference.

TECHNICAL FIELD

The present invention relates a microphone, particularly to a capacitive micro-electro-mechanical system (MEMS) microphone and a method for manufacturing the same.

BACKGROUND

The MEMS technology is an advanced technology with fast development speed in recent years. Compared with the electronic components manufactured by the traditional technology, the components manufactured by the MEMS technology have notable advantages in volume, power consumption, weight, and cost. Besides, the MEMS components can be of mass production through advanced semiconductor manufacturing process. Nowadays, the MEMS components are actually applied in pressure sensors, accelerometers, gyroscopes, and silicon microphones, and the like.

Generally, SMT technology for assembling a microphone to a circuit board needs to subject to high temperature. As for a conventional Electret Capacitor Microphone (ECM), it will become invalid because of leakage of electricity in high temperature working environment. Assembly of ECM can be achieved only via handwork. While, the capacitive MEMS microphone can subject to high temperature and can be assembled by SMT technology so that automatic assembly procedure can be used. Recently, more requirements, such as smaller-dimension, lower-cost, better-performance, of microphones are needed to be satisfied, simultaneously.

Therefore, it is required to provide an improved capacitive MEMS microphone.

SUMMARY

One objective of the present invention is to provide an improved capacitive micro-electro-mechanical system (MEMS) microphone, which is capable of improving resistance of impact.

To achieve the above objective, the present invention employs the following technical solution: A capacitive micro-electro-mechanical system (MEMS) microphone, includes: a substrate having a top surface and a bottom surface; a first dielectric supporting layer on the top surface of the substrate and defining an opening therewith; a movable sensitive layer formed on the first dielectric supporting layer and having a movable diaphragm extending within the air; a backplate disposed over the movable sensitive layer and spaced from the movable diaphragm; a chamber recessed from the bottom surface of the substrate and extending through the substrate and the first dielectric supporting layer to thereby expose the movable diaphragm, the chamber communicating with the opening of the first dielectric supporting layer; and an impact resisting device connecting to the movable diaphragm, the impact resisting device exposed downwardly within the opening of the first dielectric supporting layer and disposed above the chamber; wherein the movable sensitive layer comprises a plurality of anchors formed around the movable diaphragm which are fastened between the substrate and the backplate, a plurality of flexible beams each of which is employed to connect one of the anchors to the movable diaphragm, and a bonding portion connecting to the anchor.

As a further improvement of the present invention, the movable diaphragm is in shape of circle and the impact resisting device extends outwards from periphery of the movable diaphragm.

As a further improvement of the present invention, the impact resisting device is composed by a plurality of impact resisting members which are evenly positioned around the movable diaphragm.

As a further improvement of the present invention, the plurality of anchors are evenly positioned around the movable diaphragm, each of which connects to the movable diaphragm by the flexible beam.

As a further improvement of the present invention, the impact resisting members and the anchors are alternatively arranged.

As a further improvement of the present invention, the flexible beam is Z-shaped.

As a further improvement of the present invention, the anchor extends farther than a neighboring impact resisting member from the periphery of the movable diaphragm.

As a further improvement of the present invention, each impact resisting member is disposed over the substrate in a vertical direction.

As a further improvement of the present invention, it further comprises a second dielectric supporting layer assembled between the movable sensitive layer and the backplate.

As a further improvement of the present invention, the second dielectric supporting layer defines a room between the movable diaphragm and the backplate.

As a further improvement of the present invention, each of said impact resisting member comprises a distal portion extending from periphery of the movable diaphragm, a bearing portion formed on the backplate, and a buffer extending within the room and connecting the bearing portion and the distal portion.

As a further improvement of the present invention, the impact resisting member is disposed over the chamber and that the bearing portion, the buffer and the distal portion are arranged along a height direction of the microphone.

As a further improvement of the present invention, the backplate comprises a conductive layer and a frame layer.

As a further improvement of the present invention, an anti-adhering structure is provided on the conductive layer.

As a further improvement of the present invention, the anti-adhering structure is formed by a plurality of embossments which protrude from the backplate towards the movable diaphragm.

To achieve the above objective, the present invention also employs the following technical solution: a method for fabricating a capacitive micro-electro-mechanical system (MEMS) microphone, comprises the steps of:

S1: providing a substrate having a top surface and a bottom surface;

S2: depositing insulating material on the substrate to thereby form a first dielectric supporting layer;

S3: depositing conductive material on the first dielectric supporting layer to form a movable sensitive layer, then, defining a plurality of slits on the movable sensitive layer to form a movable diaphragm therebewteen, and forming a flexible beam on a periphery of the movable diaphragm, an anchor connecting to the flexible beam, a bonding portion connecting with the anchor, and an impact resisting device connecting with the movable diaphragm;

S4: depositing insulating material on the movable sensitive layer to form a second dielectric supporting layer;

S5: forming a conductive layer on the second dielectric supporting layer and defining a plurality of round-holes on the conductive layer;

S6: depositing insulating material on the conductive layer to form a frame layer and defining a plurality of through-holes on the frame layer, the through-holes positioned correspondingly to the plurality of round-holes, the conductive layer and the frame layer together forming a backplate, the round-holes and the through-holes constituting sound apertures;

S7: forming metallic conductive member on the bonding portion;

S8: silicon deep etching the substrate from the bottom surface to define a chamber, the chamber extending through out the substrate from the bottom surface to the top surface; and S9: removing part material of the first dielectric supporting layer, via wet etching technology, to thereby expose the movable diaphragm from the bottom surface of the substrate and make the movable diaphragm and the flexible beam suspended; and removing part material of the second dielectric supporting layer between the movable diaphragm, the flexible beam and the backplate, to thereby define a room adjacent to the chamber, the impact resisting device suspending within the room.

As a further improvement of the present invention, the step S4 comprises a step of defining recesses on the second dielectric supporting layer.

As a further improvement of the present invention, the conductive layer is formed at the recesses to thereby providing projections on the conductive layer correspondingly to the recesses, the projections projecting towards the movable diaphragm.

DETAILED DESCRIPTION OF THE EMBODIMENTS

Figure 1:
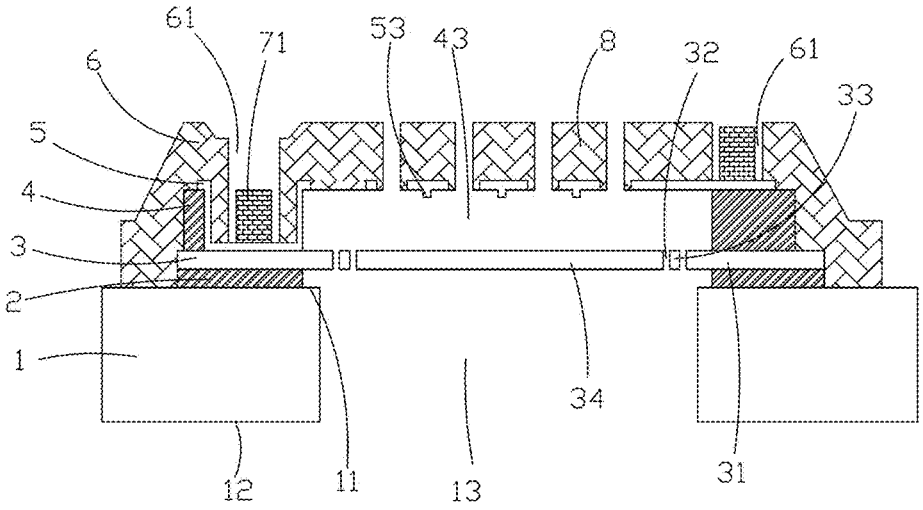
FIG. 1 is a cross-sectional view of a capacitive MEMS microphone according to one embodiment of the present invention.
Figure 2:
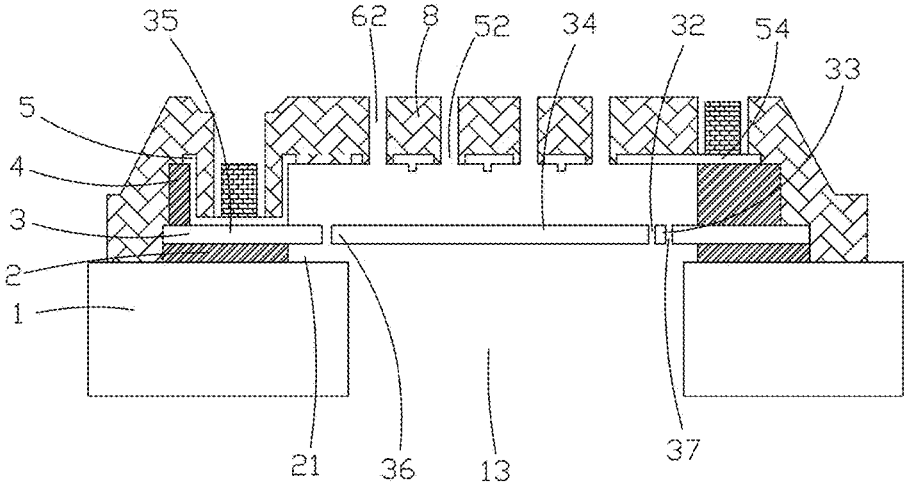
FIGS. 2 is another cross-sectional view of the capacitive MEMS microphone shown in FIG. 1 while from another aspect.
Figure 3:
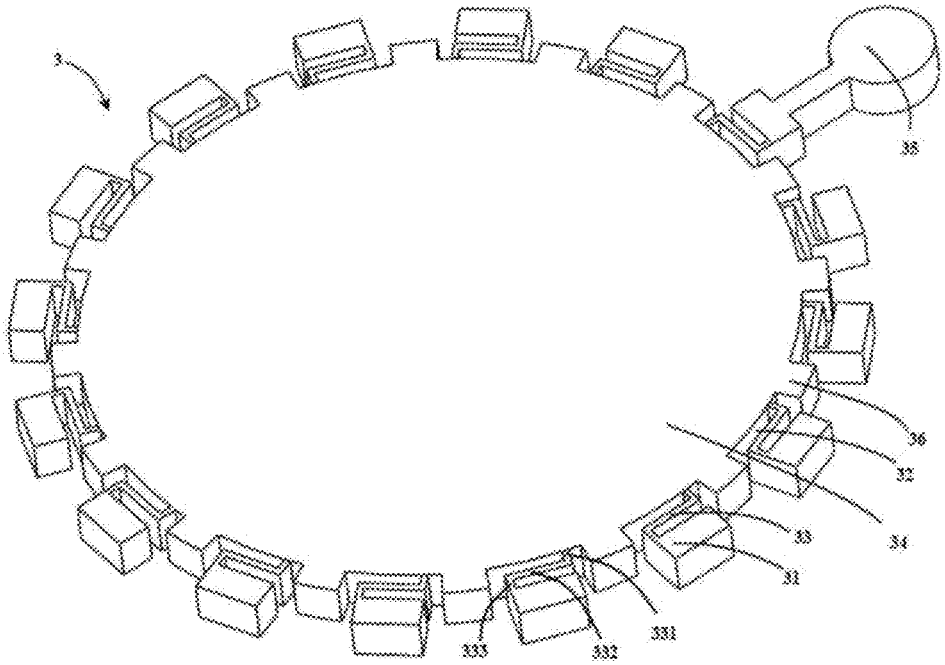
FIG. 3 is a perspective view of a movable sensitive layer of the capacitive MEMS microphone of FIG. 1.

Referring to FIGS. 1 to 3, as provided in one embodiment of the present invention, a capacitive micro-electro-mechanical system (MEMS) comprises a substrate 1 having a top surface 11 and a bottom surface 12, a first dielectric supporting layer 2 assembled on the top surface 11 of the substrate 1, a movable sensitive layer 3 disposed on the first dielectric supporting layer 2, a second dielectric supporting layer 4 provided on the movable sensitive layer 3, a conductive layer 5 provided on the second dielectric supporting layer 4, a frame layer 6 provided on the conductive layer 5, a metallic conductive member 71 and an impact resisting device 36 employed to prevent an undesired floating of the movable sensitive layer 3 which is subject to a large shock. The conductive layer 5 and the frame layer 6 together defines a backplate 8 which is above the movable sensitive layer 3.

The substrate 1 can be formed by silicon or glasses which have metal material covered thereon. The first dielectic supporting layer 2 is positioned between the movable sensitive layer 3 and the substrate 1, which is used to support the movable sensitive layer 3 on the substrate 1 and electrically isolate the movable sensitive layer 3 from the substrate 1. A chamber 13 is defined between the substrate 1 and the first dielectric supporting layer 2, which is recessed from the bottom surface 12 of the substrate 1 and extends towards the top surface 11 of the substrate 1. The movable sensitive layer 3 is thereby exposed to the chamber 13. The chamber 13 can be of either a circular shape or a rectangular shape. The shape of the chamber 13 can be designed according to actual requirement. The first dielectric supporting layer 2 comprises an opening 21 communicating with the chamber 13.

Referring together to FIGS. 1 to 3, the movable sensitive layer 3 is positioned between the first dielectric supporting layer 2 and the second dielectric supporting layer 3. The movable sensitive layer 3 includes a movable diaphragm 34 exposed and suspended in the chamber 13, a plurality of anchors 31 formed around the movable diaphragm 34, which are fastened between the backplate 8 and the substrate 1, a plurality of flexible beams 33 each of which is employed to connect one of the anchors 31 to the movable diaphragm 34, and a bonding portion 35 connecting to one of the anchors 31 for electrical signals transmission. The flexible beams 33 are also exposed downwardly to the chamber 13.

In the preferred embodiment, the shape of the movable diaphragm 34 is provided correspondingly to the shape of the chamber 13, which is in circle shape. Understandably, the movable diaphragm 34 can has other shapes. The flexible beams 33 and the anchors 31 are evenly disposed around the periphery of the movable diaphragm 34. The flexible beams 33 are Z-shaped and comprises a first connecting portion 331 connecting to the peripheral edge of the movable diaphragm 34, a second connecting portion 333 connecting the first connecting portion 331 and the corresponding anchor 31, and a beam body 332 interconnecting the first connecting portion 331 and the second connecting portion 333. In the preferred embodiment, the first connecting portion 331 and the second connecting portion 333 extend substantially along a radial direction of the movable diaphragm 34. A slit 32 is defined between the movable diaphragm 34 and the beam body 332 and a groove is defined between the anchor 31 and the beam body 332. By such slits 32 and grooves 37, the flexible beams 33 provide enough space for buffer of undesired force.

The movable diaphragm 34 and the flexible beams 33 are suspended positioned, which together constitute a movable structure of the movable sensitive layer 3. Under the sound pressure, the movable structure can be vibrated to thereby generate vary electric capacity. The anchors 31 are distributed around the movable diaphragm 34, and are fastened to the substrate 1 through the first dielectric supporting layer 2.

Together referring to FIGS. 1 to 3, in the preferred embodiment, the impact resisting device is composed by a plurality of impact resisting members 36 which is formed in a shape of projection 36. The projection 36 extends into the opening 21 and suspends overhead the substrate 1 in a vertical direction. When the movable diaphragm 34 subjects to outside undesired shocks and then moves to the chamber 13, the movement of the projection 36 is limited by the substrate 1 so as to limit the distance of the movable diaphragm 34 in an acceptable, designed range. Further, the flexible beams 33 are also protected to move in a limited range.

In the preferred embodiment, the impact resisting device 36 is formed on the periphery of the movable diaphragm 34 and extends along a radial direction. The impact resisting members 36 and the plurality of anchors 31 together with the corresponding flexible beams 33 are alternatively arranged. The anchor 31 extends farther than a neighboring impact resisting member 36 from the periphery of the movable diaphragm 34.

Referring to FIGS. 1 and 2, the second dielectric supporting layer 4 is positioned between the movable sensitive layer 3 and the backplate 8. A thickness of the seond dielectric supporting layer 4 effects the distance between of the movable sensitive layer 3 and the backplate 8. The second dielectric supporting layer 4 defines a room 43 between the movable diaphragm 34 and the backplate 8. Consequently, the movable diaphragm 34 and the conductive layer 5 of the backplate 8 achieve a capacity. The movable diaphragm 34 and the conductive layer 5 are regards as two electrode plates.

In the backplate 8, round holes 52 and soldering points 54 are formed on the conductive layer 5. The soldering point 54 electrically connects with the bonding portion 35. The round hole 52 transmits sounds to the movable diaphragm 34 and provides path for corrosive liquid during releasing procedure. when fabricating the microphone The frame layer 6 is positioned above the conductive layer 5 and defines through holes 62 transmitting sounds to the movable diaphragm 34. Also the through holes 62 provide paths for corrosive liquid during releasing procedure. The locations and the dimensions of the round holes 52 and the through holes 62 are the same to thereby together define sound holes. The sound holes can be circle or other shapes. An anti-adhering structure 53 is provided on the conductive layer 5. In the preferred embodiment, the anti-adhering structure 53 is formed by a plurality of embossments which protrude from the backplate 8 towards the movable diaphragm 34. The embossments 53 and the round holes 52 of the conductive layer 5 are alternatively arranged to thereby prevent the movable diaphragm 34 from adhering to the conductive layer 5. The shapes of the embossment 53 can be either circle or rectangle. The frame layer 6 provides cutouts 61 locating above and exposing the bonding portion 35 and the soldering point 53. The metallic conductive member 71 is positioned in the cutout 61 for signal transmission. Understandably, the frame layer 6 and the conductive layer can switch positions.

Figure 16:
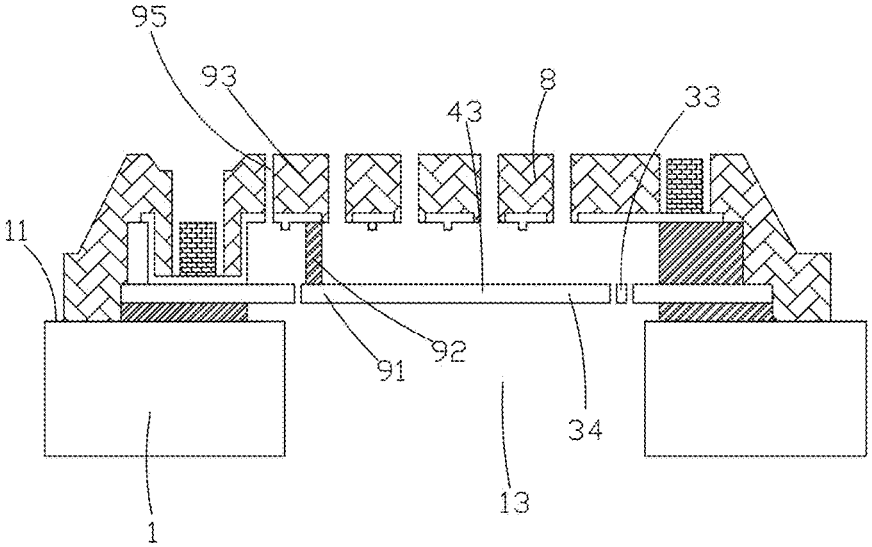
FIG. 16 is a cross-sectional view of the capacitive MEMS microphone according to the other embodiment of the present invention.

Turning to FIG. 16, according to the other embodiment of the present invention, the impact resisting device can be achieved by different structure compared to the first embodiment. In this embodiment, the impact resisting device includes a distal portion 91 connecting to a periphery edge of the movable diaphragm 34, a bearing portion 93 positioned on the backplate 8, and a buffer 92. The buffer 92 is located in the room 43 of the second dielectric supporting layer 4 and connecting the distal portion 91 and the bearing portion 93. The buffer 92 is overhead the chamber 13. A bearing hole 95 is defined between the bearing portion 93 and other part of the backplate. In this embodiment, when the movable diaphragm 34 subjects to shock and moves to the chamber 13, the buffer 93 can be stopped by the substrate 1 so as to protect the flexible beams 33 from destroy due to undesired large movement.

Referring together to FIGS. 4 to 15, a method of fabricating the capacitive MEMS microphone includes following steps.

Figure 4:
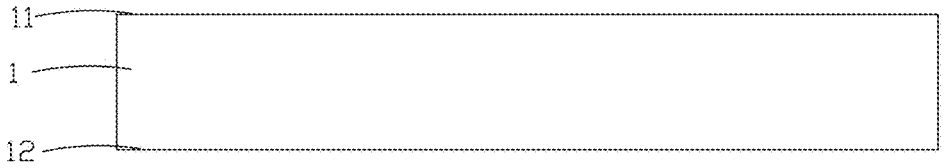
FIGS. 4-15 are schematic views showing a processing procedure of fabricating the capacitive MEMS microphone illustrated in FIG. 1, respectively.

Referring to FIG. 4, in step S1, a substrate 1 having a top surface 11 and a bottom surface 12 is provided. The substrate 1 can be formed by either silicon or glasses with metallic layer covered thereon. The substrate 1 is employed to provide supporting to others components.

Figure 5:
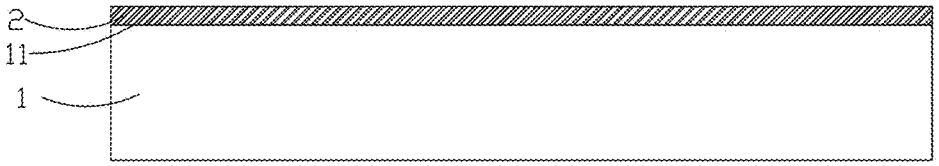

Referring to FIG. 5, in step S2, a first dielectric supporting layer 2 is formed by depositing dielectric material on the top surface 11 of the substrate 1. The dielectric material can be oxidized silicon.

Figure 6:
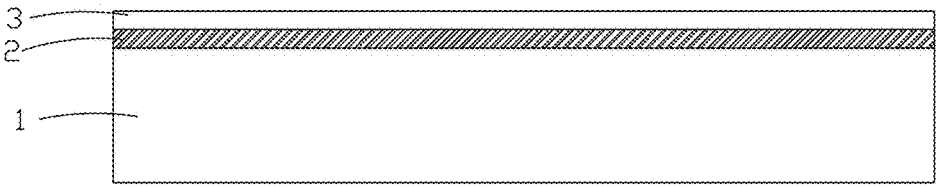
Figure 7:
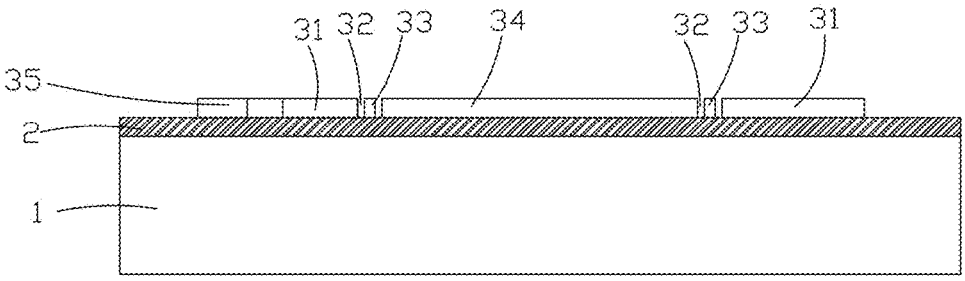

Together referring to FIGS. 3, 6 and 7, in step S3, a movable sensitive layer 3 is formed by depositing conductive material on the first dielectric supporting layer 2. The conductive material can be polysilicon, which makes the movable sensitive layer 2 conductive. Simultaneously, a plurality of slits 32 are defined on the movable sensitive layer 2 to form a movable diaphragm 34 therebewteen by lithography/photoetching, anisotropic etching. A flexible beams 33 on a periphery of the movable diaphragm 34, an anchor 31 connecting to the flexible beam 33, a bonding portion 35 connecting with the anchor 31, and an impact resisting device 36 connecting with the movable diaphragm 34 are also formed. During forming procedure, the dimension of the movable diaphragm 34 is defined by the slit 32.

Figure 8:
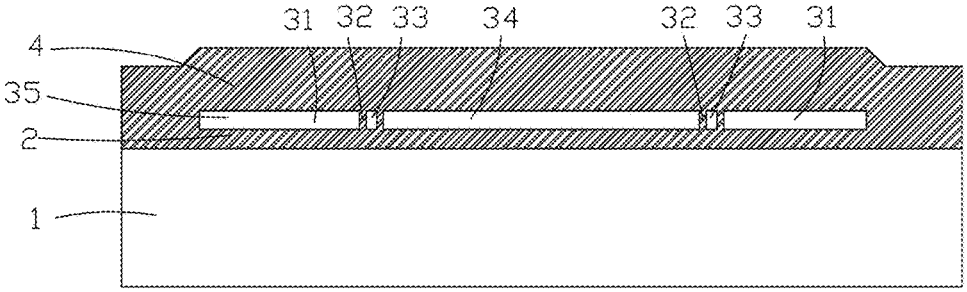
Figure 9:
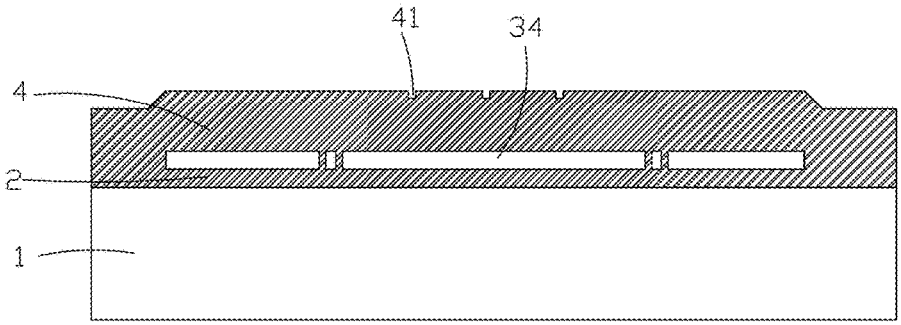
Figure 10:
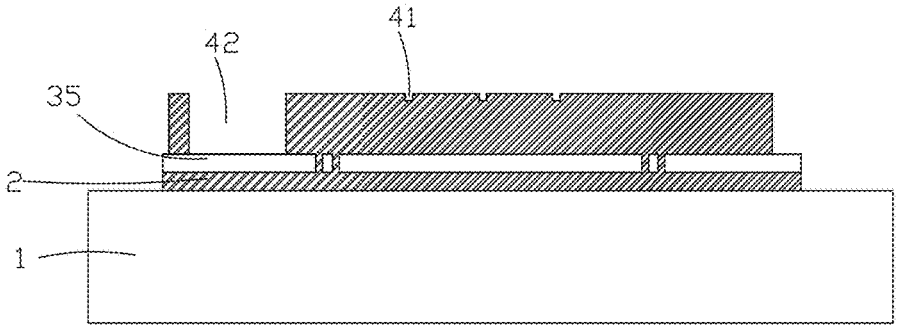

Turning to FIGS. 8 to 10, in step S4, a second dielectric supporting layer 4 is formed on the movable sensitive layer 3 by depositing oxidized silicon thereon. S4 comprises steps S41 to S43.

Referring to FIG. 8, in step S41, the second dielectric supporting layer 4 is formed on the movable sensitive layer 3 by depositing oxidized silicon thereon.

Referring to FIG. 9, in step S42, by photoetching, etching mask, anisotropyic etching etc. technologies, a plurality of recesses 41 are defined on the second dielectric supporting layer 4. The recesses 41 are overhead the movable diaphragm 34.

Referring to FIG. 10, in step S43, by photoetching, the bonding portion 35 is exposed from the second dielectric supporting layer 4.

Figure 11:
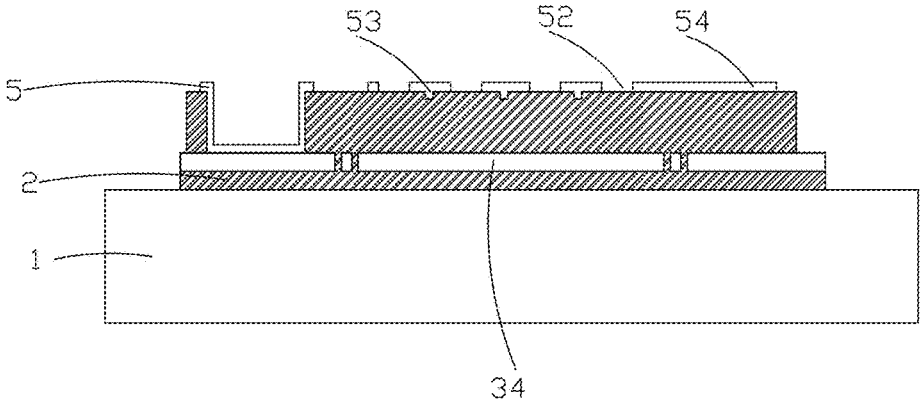

Together referring to FIGS. 1 and 11, in step S5, by chemical vapor deposition (CVD) technology, polysilicon is deposited on the second dielectric supporting layer 4 to thereby form the conductive layer 5. Then, by photoetching or etching, the round holes 52 and the soldering points 54 are defined. During forming the conductive layer 5, the conductive material fills in the recesses 41 and the projections 54 are formed. The projections 54 are provided to prevent the backplate 8 from the movable diaphragm 34. Understandably, the projections 53 are also formed overhead the movable diaphragm 34.

Figure 12:
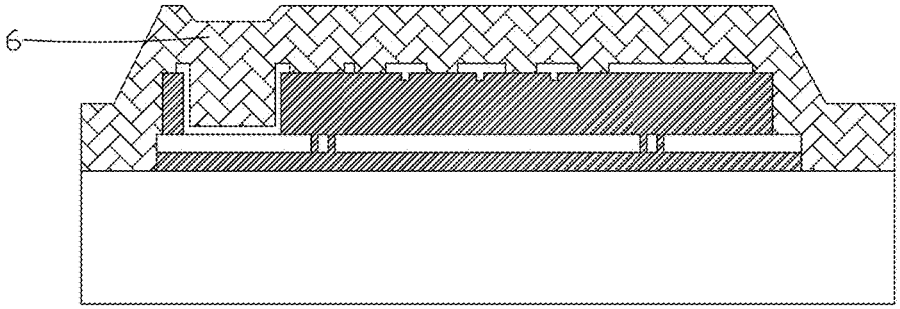
Figure 13:
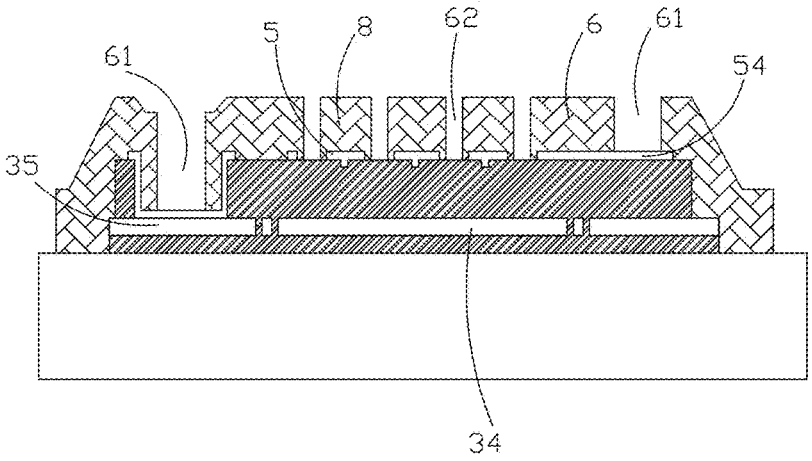

Together referring to FIGS. 12 and 13, in step S6, by CVD technology, the dielectric material is deposited on the conductive layer 5 to thereby form the frame layer 6. The dielectric material can be silicon nitride. Then, by photoetching or etching, the through holes 62 are formed on the frame layer 6. The locations and the dimensions of the round holes 52 and the through holes 62 are same to thereby together define the sound holes. The embossments 53 and the sound holes are alternatively arranged to thereby prevent the movable diaphragm 34 from adhering to the conductive layer 5. The sound holes are positioned overhead the movable diaphragm 34. Simultaneously, in step S6, the cutouts 61 are formed and the bonding portion 35 and the soldering points 54 are exposed from the cutouts 61.

Figure 14:
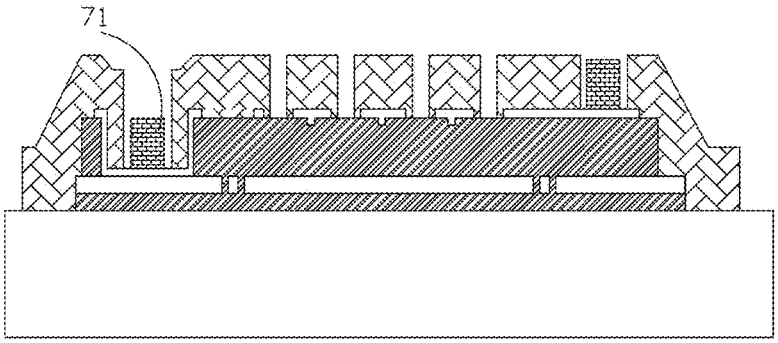

Referring to FIG. 14, in step S7, by sputtering, photoetching, etching etc. technologies, the metallic conducive member 71 is formed and connects to the bonding portion 35.

Figure 15:
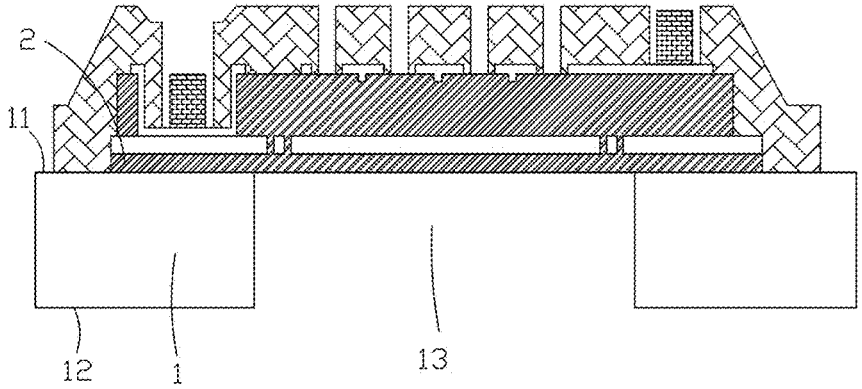

Referring to FIGS. 15, in step S8, by dual surface lithography and silicon deep etching, a part of the chamber 13 is formed on the bottom surface 12 of the substrate 1 and extends to the top surface 11. In this step, the silicon deep etching is halted at the first dielectric supporting layer 2 which is deemed as a stopping layer. The shape and the dimension of the chamber 13 are designed according to the requirements, which can be either round or rectangle.

Referring to FIGS. 1 and 2, in step S9, wet etching is operated from the chamber 13 and the sound holes on the opposed side. Part of the first dielectric supporting layer 1 is removed and the movable diaphragm 34 is exposed from the chamber 13. At this time, the movable diaphragm 34 and the flexible beams 33 are suspending. The impact resisting device or members 36 are suspended and located between the substrate 1 and the backplate 8. The room 43 is formed by removing part of material from the dielectric supporting layer 4, which is between the movable diaphragm 34, the flexible beams 33 and the backplate 8. The suspending, movable diaphragm 34 is worked as movable structure of the movable sensitive layer 3. The movable diaphragm 34 and the backplate 8 are worked as two electrode plates correspondingly and define a capacitor therebetween.

In summary, the present invention of the capacitive MEMS microphone can fully release residual stresses deriving from the processing. In other words, the fabricating process does not affect the sensitivity of the capacitive MEMS microphone. Moreover, by employing flexible beams 33, it is easily to obtain high sensitivity and high signal-noise ration (SNR) of the microphone while the dimensions of the chip should not be changed to be large. Further, the impact resisting device and the projections protect the movable diaphragm 34 and the flexible beams 33 from damages of any undesired shocks.

Additionally, by employing the present fabricating method, the dimensions of the capacitive MEMS microphone is reduced and the qualities of the microphones from different batches remains the same. Further, the stress from packaging procedure is reduced which may effect the sensitivity of the microphone.

Although some preferred embodiments of the present invention have been disclosed for illustration purpose, persons of ordinary skill in the art will appreciate that various improvements, additions, and replacements may be made without departing from the scope and spirit of the present invention as disclosed in the appended claims.

What is claimed is:

1. A capacitive micro-electro-mechanical system (MEMS) microphone, comprising:

a substrate having a top surface and a bottom surface;

a first dielectric supporting layer on said top surface of said substrate and defining an opening therewith;

a movable sensitive layer formed on said first dielectric supporting layer and having a movable diaphragm extending within the air;

a backplate disposed over said movable sensitive layer and spaced from said movable diaphragm;

a chamber recessed from said bottom surface of said substrate and extending through said substrate and said first dielectric supporting layer to thereby expose said movable diaphragm, said chamber communicating with said opening of said first dielectric supporting layer; and an impact resisting device connecting to said movable diaphragm, said impact resisting device exposed downwardly within said opening of said first dielectric supporting layer and disposed above said chamber;

wherein said movable sensitive layer comprises a plurality of anchors formed around said movable diaphragm which are fastened between said substrate and said backplate, a plurality of flexible beams each of which is employed to connect one of said anchors to said movable diaphragm, and a bonding portion connecting to said anchor, and each flexible beam comprises a first connecting portion connecting to the peripheral edge of the movable diaphragm, a second connecting portion connecting the first connecting portion and the corresponding anchor, and a beam body interconnecting the first connecting portion and the second connecting portion.

2. The capacitive MEMS microphone according to claim 1, wherein said movable diaphragm is in shape of circle and said impact resisting device extends outwards from periphery of said movable diaphragm.

3. The capacitive MEMS microphone according to claim 2, wherein said impact resisting device is composed by a plurality of impact resisting members which are evenly positioned around said movable diaphragm.

4. The capacitive MEMS microphone according to claim 3, wherein said plurality of anchors are evenly positioned around said movable diaphragm, each of which connects to said movable diaphragm by said flexible beam.

5. The capacitive MEMS microphone according to claim 4, wherein said impact resisting members and said anchors are alternatively arranged.

6. The capacitive MEMS microphone according to claim 4, wherein said flexible beam is Z-shaped.

7. The capacitive MEMS microphone according to claim 4, wherein said anchor extends farther than a neighboring impact resisting member from said periphery of said movable diaphragm.

8. The capacitive MEMS microphone according to claim 3, wherein each impact resisting member is disposed over said substrate in a vertical direction.

9. The capacitive MEMS microphone according to claim 3, further comprising a second dielectric supporting layer assembled between said movable sensitive layer and said backplate.

10. The capacitive MEMS microphone according to claim 9, wherein said second dielectric supporting layer defines a room between said movable diaphragm and said backplate.

11. The capacitive MEMS microphone according to claim 10, wherein each of said impact resisting member comprises a distal portion extending from periphery of said movable diaphragm, a bearing portion formed on said backplate, and a buffer extending within said room and connecting said bearing portion and said distal portion.

12. The capacitive MEMS microphone according to claim 11, wherein said impact resisting member is disposed over said chamber and that said bearing portion, said buffer and said distal portion are arranged along a height direction of said microphone.

13. The capacitive MEMS microphone according to claim 1, wherein the backplate comprises a conductive layer and a frame layer.

14. The capacitive MEMS microphone according to claim 13, wherein an anti-adhering structure is provided on the conductive layer.

15. The capacitive MEMS microphone according to claim 14, wherein the anti-adhering structure is formed by a plurality of embossments which protrude from the backplate towards the movable diaphragm.

* * * * *